United States Patent [19]

Gerome

[11] 4,384,375

[45] May 24, 1983

[54] MEANS FOR RAPIDLY FIXING SEAT TO WATER CLOSET BOWL

[76] Inventor: Jacques Gerome, 7 Bis, Rue de Dijon, 88100 Saint-Die (Vosges), France

[21] Appl. No.: 239,167

[22] Filed: Feb. 27, 1981

[51] Int. Cl.[3] ..... A47K 13/12

[52] U.S. Cl. ..... 4/240; 4/236; 4/661; 292/251.5

[58] Field of Search ..... 4/236, 234, 240, 237, 4/239, 241, 661; 16/DIG. 14; 297/251.5

[56] References Cited

U.S. PATENT DOCUMENTS

| | | | |
|---|---|---|---|
| 2,535,789 | 12/1950 | De Bell | 4/236 |
| 2,840,408 | 6/1958 | Scott et al. | 292/251.5 |
| 2,901,278 | 8/1959 | Robinson | 292/251.5 |
| 3,016,563 | 1/1962 | De Jong | 292/251.5 X |
| 3,174,786 | 3/1965 | Wilson | 292/251.5 |
| 3,388,418 | 6/1968 | Bey | 292/251.5 X |
| 4,021,891 | 5/1977 | Morita | 292/251.5 X |
| 4,122,563 | 10/1978 | Johnson | 16/DIG. 14 X |

*Primary Examiner*—Henry K. Artis

*Attorney, Agent, or Firm*—Robert E. Burns; Emmanuel J. Lobato; Bruce L. Adams

[57] ABSTRACT

A fixture for removably fixing a seat to the bowl or pan of a water closet comprises upwardly projecting studs secured to the water closet pan by bolts extending through holes in the pan and having washers and nuts on their lower ends. The studs are received in downwardly opening sockets provided in the seat to resist forces tending to move the seat horizontally relative to the pan. Permanent magnets in the sockets act between the seat and pan to resist upward movement of the seat relative to the pan.

7 Claims, 6 Drawing Figures

MEANS FOR RAPIDLY FIXING SEAT TO WATER CLOSET BOWL

The invention relates to a means for rapidly fixing a seat to a water closet pan, which means comprises a fixed portion secured to a fixing aperture of the pan and a guide secured to the seat in order to enable attachment and removal of the seat at will by simple traction or pressure exerted on the seat.

A water closet is already known from the French Pat. No. 794 954 which is characterised in that the support of the axis of rotation of the seat comprises on its inner surface two apertures in which the edges of several rings are engaged. These rings are rigid with the lower side of this support by means of fixing screws. The internal surface of these rings is provided with a spring cooperating with a piston having a frustum connected to a cylindrical component by means of a fillet.

The device of this patent enables the support to be readily removed and, consequently, the seat of the water closet. However it is often the case that the support is wet and, as a result of this, the wood cracks and the rings become separated from the support. The seat is therefore no longer fixed. In addition, this device is very costly as a result of the large number of elements used in its construction.

The French Pat. No. 72.06604 published under No. 2 173 481 also discloses a water closet seat whose flap is articulated with a pan provided with uprights equipped with a sleeve by means of two arms whose end supports a projection or a trunnion engaging with the sleeve. The flap seat may be separated from the pan by hand by varying the spacing of the arms such that the trunnion is released from the sleeve.

The German Auslegeschrift No. 1 020 451 also discloses a device for fastening the seat comprising a resilient annular element which is rigid with the end of a fixing screw. This resilient annular element engages in a groove provided in a housing in the lower side of the seat.

The present invention is designed to provide a fixing means comprising very few elements and which is therefore inexpensive, whilst enabling, by simple manual pressure or traction, the seat fastened to the pan to be removed instantly and without difficulty without the use of tools and without the need to work from the back or from below the pan.

For this purpose, the invention relates to a means for rapidly fixing a seat to a water closet pan comprising a fixed portion secured to a fixing aperture of the pan and a guide secured to the seat by simple traction or pressure exerted on the seat, characterised in that the upper portion of the fixed portion constitutes, with the guide, a joint with a magnetic connection between the fixed portion and the guide.

The invention will be understood by reference to the following description made by way of non-limiting example and to the attached drawings, in which.

Figure 1:
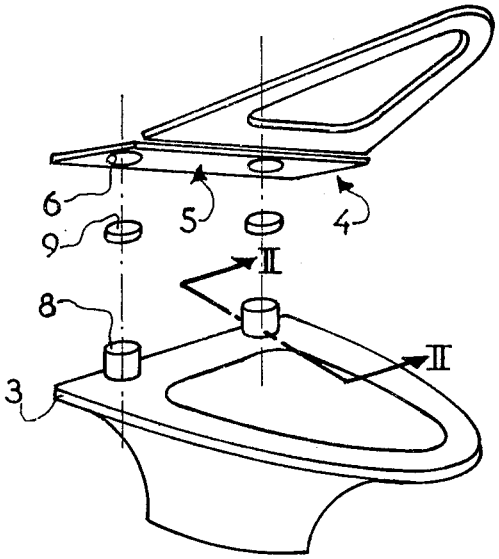
FIG. 1 is an exploded view in perspective of a pan and a seat of a water closet provided with a rapid fixing means in accordance with the invention.
Figure 2:
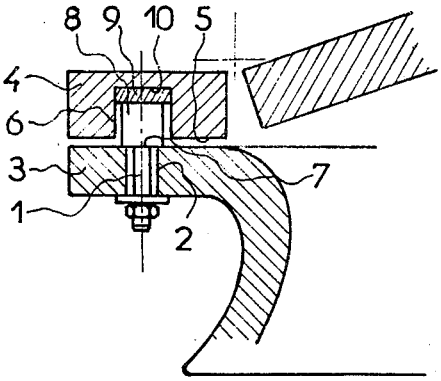
FIG. 2 is an enlarged view along the section II—II of FIG. 1.

With reference to FIGS. 1 and 2, fixed portions 1 on the pan of a water closet comprise upwardly projecting stud portions and bolt portions which extend down through apertures 2 of the pan 3 and are secured by nuts on their lower ends. A seat 4 fitted on the pan comprises sockets serving as guides 6 for the fixed portions 1 on its lower surface 5. A permanent magnet 8 cooperating with an armature shown as a magnetic plate 9 rigid with the base 10 of the guides 6 is disposed on the upper surface 7 of the fixed portion 1.

Figure 3:
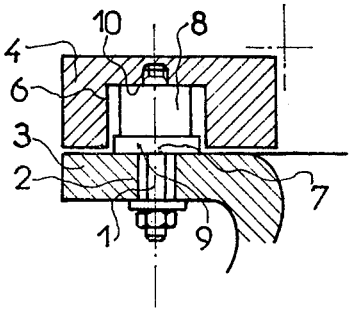
FIG. 3 is a partial view in section and elevation of the rapid fixing means in accordance with a further embodiment.

In accordance with a further embodiment, the upper surface 7 of the fixed portion 1 comprises a magnetic plate 9, whilst the permanent magnet 8 is rigid with the base 10 of the guides 6 (See FIG. 3).

When a seat 4 is fixed to a pan 3 of a water closet using the rapid fixing means of the invention, the seat 4 is instantaneously unlocked from the pan 3 by breaking the force of magnetic connection by means of vertical traction on the seat 4. For repositioning, on the other hand, the seat 4 is positioned by means of the guides 6 and is maintained in place as a result of the cooperation due to the magnetic force of the permanent magnet 8 and the magnetic plate 9.

Figure 4:
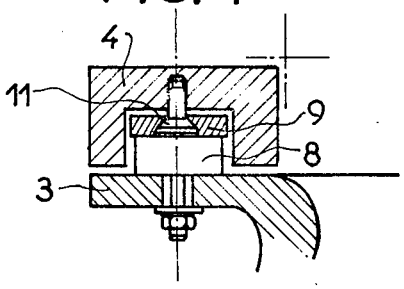
FIG. 4 is a partial view in section and elevation of the rapid fixing means provided with means improving the cooperation of the various elements.
Figure 5:
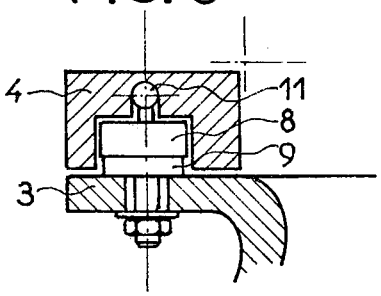
FIG. 5 is a partial view in section and elevation of a further embodiment of the means improving the cooperation of the various elements of the rapid fixing means.

Reference is now made to FIGS. 4 and 5 which show an improvement designed to improve the contact between the permanent magnet 8 and the magnetic plate 9: either the magnetic plate is made rigid with base 10 of the guide 6 by means of an element 11 such as a ball and socket joint which permits the oscillation of the magnetic plate 9 (see FIG. 4), or the permanent magnet 8 is made rigid with the base 10 of the guide 6 by means of the ball and socket joint 11.

Figure 6:
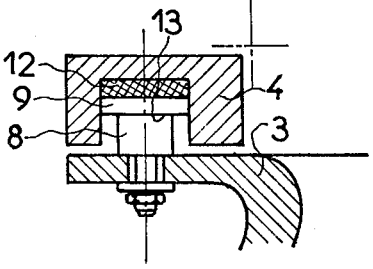
FIG. 6 is a partial view in section and elevation of further means improving the cooperation of the various elements of the rapid fixing means.

With reference to FIG. 6, which shows a further improvement of the contact between the permanent magnet 8 and the magnetic plate 9, this improvement is due to the interposition between the magnetic plate 9 and the base 10 of the guide 6 of a resilient washer 12 which enables, in particular under the weight of a user, the magnetic plate 9 to be located perfectly parallel to the support surface 13 of the permanent magnet 8.

In the accordance with the embodiment selected, the resilient washer 12 is disposed between the base 10 of the guide 6 and the permanent magnet 8 when the latter is rigid with the lid 4.

The rapid fixing means which is the subject matter of the present invention, may be used with all types of water closet seats whether these are provided with lids or not. It is particularly useful in communities, hotels, hospitals in which it is thus possible to have a simple disposable seat and a pan which is readily accessible for cleaning.

Although the invention has been described with reference to a particular embodiment, it is understood that this is in no way limiting and that it may be subject to various modifications of shape, materials, combinations of these various elements, without departing from the scope of the invention.

I claim:

1. Means removably fixing a seat to the pan of a water closet, comprising fixing means on said pan comprising studs projecting up from said pan and having bolt means extending through apertures in said pan and secured thereto, guide means in said seat comprising downwardly opening sockets in said seat closely receiving said studs to resist forces tending to move said seat horizontally relative to said pan, and permanent magnetic means acting between said fixing means and said guide means releasably to resist upward movement of said seat relative to said pan.

2. Water closet fixing means according to claim 1, in which said magnetic means comprises permanent magnets comprised in said studs and an armature secured in each of said sockets.

3. Water closet fixing means according to claim 1, in which said magnetic means comprises permanent magnets in said sockets and an armature comprised in each of said studs.

4. Water closet fixing means according to claim 2 or claim 3, in which said permanent magnets are mounted by ball and socket joints permitting limited tilting movement to provide close contact between the permanent magnets and the armatures.

5. Water closet fixing means according to claim 2 or claim 3, in which said armatures are mounted by ball and socket joints permitting limited tilting movement to provide close contact between the permanent magnets and the armatures.

6. Water closet fixing means according to claim 2 in which resilient means between the base of said socket and said armature permits limited tilting movement and limited vertical movement of said armature in said socket.

7. Water closet fixing means according to claim 3, in which resilient means between the base of said socket and said permanent magnet permits limited tilting movement and limited vertical movement of said magnet in said socket.

* * * * *